US005524150A

United States Patent [19]

Sauer

[11] Patent Number: 5,524,150

[45] Date of Patent: Jun. 4, 1996

[54] HEARING AID PROVIDING AN INFORMATION OUTPUT SIGNAL UPON SELECTION OF AN ELECTRONICALLY SET TRANSMISSION PARAMETER

[75] Inventor: Joseph Sauer, Strullendorf, Germany

[73] Assignee: Siemens Audiologische Technik GmbH, Erlangen, Germany

[21] Appl. No.: 347,185

[22] Filed: Nov. 22, 1994

Related U.S. Application Data

[63] Continuation of Ser. No. 11,808, Feb. 1, 1993, abandoned.

[30] Foreign Application Priority Data

Feb. 27, 1992 [DE] Germany ..... 42 06 084.2
May 27, 1992 [DE] Germany ..... 42 17 629.8

[51] Int. Cl.[6] ..... H04R 25/00

[52] U.S. Cl. ..... 381/68; 381/68.7; 381/68.2

[58] Field of Search ..... 381/68, 68.2, 68.4, 381/68.7, 23.1; 379/447

[56] References Cited

U.S. PATENT DOCUMENTS 4,425,481 1/1984 Mansgold et al. ..... 381/68
4,777,474 10/1988 Clayton ..... 381/68
5,140,632 8/1992 Anten ..... 379/447
5,210,803 5/1993 Martin et al. .

FOREIGN PATENT DOCUMENTS 0064042 1/1986 European Pat. Off. .
0335542 10/1989 European Pat. Off. .
0381608 8/1990 European Pat. Off. .

*Primary Examiner*—Curtis Kuntz
*Assistant Examiner*—Sinh Tran
*Attorney, Agent, or Firm*—Hill, Steadman & Simpson

[57] ABSTRACT

A hearing aid to be worn behind the ear of a user includes a microphone. An earphone is also provided. The microphone and earphone are electrically connected by a signal path. An electronic setting circuit is provided in the signal path for electrically setting at least one transmission parameter in the signal path. The electronic setting circuit is controlled by a switch of the hearing aid. A signal output device is also provided, and is controlled by the switch. The signal output device provides information to the user regarding the transmission parameter selected. The signal output device outputs at least one signal that is characteristic of every electronically set transmission parameter.

7 Claims, 2 Drawing Sheets

HEARING AID PROVIDING AN INFORMATION OUTPUT SIGNAL UPON SELECTION OF AN ELECTRONICALLY SET TRANSMISSION PARAMETER

This is a continuation of application Ser. No. 08/011,808, filed Feb. 1, 1993, now abandoned.

BACKGROUND OF THE INVENTION

1. Field of the Invention

The present invention relates generally to a hearing aid to be worn on the head, particularly behind an ear of a user. The hearing aid includes a signal path between a microphone and an earphone. At least one electronic setting circuit is provided in the signal path for electronically setting at least one transmission parameter in the signal path. The electronic setting circuit is controlled by a switch of the hearing aid.

2. Description of the Prior Art

A hearing aid including a signal path between a microphone and an earphone having at least one electronic setting circuit provided in the signal path for electrically setting at least one transmission parameter in the signal path, where the electronic setting circuit is controlled by a switch of the hearing aid, is discussed, for example, in European Patent EP-B-0 064 042. The signal path between the microphone and the earphone is matched to a variety of sound environments, or hearing environments, by a switch of the hearing aid, based on pre-programmed transmission parameters. The switch can be either manually actuatable or automatically actuatable. In order to manually actuate the switch, the user of the hearing aid must know what program is set at the hearing aid.

However, a hearing-impaired user cannot see the hearing aid while using the hearing aid. Further, the hearing-impaired user cannot see a potentially present marking of the switch position of a manually actuatable program selection switch provided on the hearing aid while using the hearing aid. As the sound environments, or hearing environments, change frequently for a hearing-impaired user, the user of the hearing aid can easily forget the most recent setting selected. If the user forgets the most recent setting of the hearing aid selected, and wishes to identify the setting selected, the user must either remove the hearing aid from his head to identify the selected program, based on the marking of the switch position, or must, first, switch the signal transmission path of the hearing aid into an initial position, and proceeding from this initial position, continue switching the switch up to the desired setting. However, manually adjusting the hearing aid in this manner, according to such a procedure, is extremely time-consuming and complicated. Older users of a hearing aid, in particular, can be overburdened as a result of the complexity of such a procedure. Further, when the program selection occurs based on an automatically operating circuit, the user receives no information about the program that was automatically selected, or concerning the automatically selected transmission parameter.

SUMMARY OF THE INVENTION

It is an object of the present invention to improve user recognition of a selected transmission parameter in a hearing aid including a signal path between a microphone and an earphone having at least one electronic setting circuit for setting at least one transmission parameter in the signal path, where the electronic setting circuit is controlled by a switch of the hearing aid.

The above object is inventively achieved in a hearing aid including a microphone and an earphone. At least one electronic setting circuit is provided. The electronic setting circuit is electrically connected to the microphone and the earphone. The electronic setting circuit sets at least one transmission parameter in a signal path between the microphone and the earphone. A signal output device is also provided. The signal output device is electronically connected to the electronic setting circuit and to the earphone. The signal output device transmits at least one signal to the earphone, where the signal is characteristic of every electronically set transmission parameter. A switch is also provided. The switch is electrically connected to the electronic setting circuit and to the signal output device. The switch selectively activates the electronic setting circuit and the signal output device.

Thus, in accordance with the principles of the present invention, a signal output device that provides an output of at least one signal that is characteristic of every electronically set transmission parameter and the electronic setting circuit are both controlled by the switch. Thus, the switch not only sets a transmission parameter of the signal path, matching a particular hearing environment, or sound environment, but also controls the signal output device.

The signal can be output in an arbitrary manner. A particularly advantageous embodiment provides a signal output that can be acoustically perceived by the user of the hearing aid. For example, the signal output device can be designed as an audio frequency generator that outputs at least one electrical signal to the signal path between the microphone and the earphone, where the signal is characteristic of every electronically set transmission parameter. As a result, the electrical signal output of the audio frequency generator proceeds through the earphone and into an ear of the user of the hearing aid, and serves as an acoustic signal through the earphone of the hearing aid. The hearing aid user can then perceive the acoustic signal without having to remove the hearing aid from his head.

The signal output from the audio frequency generator through the earphone can be output in a simple manner and can provide, for example, a whistling tone. The whistling tone can, for example, be output only once given a first parameter setting, twice given a second parameter setting and, finally, n times given an $n^{th}$ parameter setting. The whistling tone can be output with, for example, the same frequency. Thus, the user of the hearing aid receives information concerning the respectively switched transmission parameter through the earphone of the hearing aid, based on the actuation of the switch at every switching of the transmission parameters, without taking any additional action to ascertain information about the switch transmission parameter. The switch for the program selection/parameter setting can be designed as a manually actuatable switch, or as an automatically operating switch.

In a particularly advantageous embodiment of a hearing aid constructed in accordance with the principles of the present invention, a timer circuit is provided. The effect of the manually actuatable switch on the signal output device and/or on the electronic setting circuit is controllable through the timer circuit. The timer circuit can control actuation of the electronic setting circuit and the output signal device such that only the signal output device is switched given a first actuation of the switch within a prescribed time span. As a result, the user of the hearing aid is first provided with information concerning the transmission parameter that has already been switched. When the switch is activated again within a prescribed time period, a new transmission parameter is electronically set. The new setting of the new transmission parameter is confirmed for the user by outputting a different signal from the signal output device.

Consequently, the user of the hearing aid can call in information concerning the transmission parameter set at a given point in time. Further, the user receives a different signal when the switch is subsequently actuated for the program selection/parameter setting that, for example, characterizes another transmission parameter that is then set. The different signal also serves as a confirmation to the user that the other parameter has, in fact, been set. Thus, malfunctioning of the hearing aid, which can occur when the manually actuatable switch for setting hearing aid parameters is actuated, but is insufficiently actuated such that a switching to, for example, a different signal processing program does not occur, can be avoided. This is particularly advantageous given older hearing aid users.

In another embodiment of a hearing aid constructed in accordance with the principles of the present invention, the signal output device is designed as a voice generator. As a result, a voice signal that outputs, for example, the words "first program" can be made accessible to the user of the hearing aid through the earphone of the hearing aid. Thus, direct information about the selected setting of the hearing aid can be provided to the user.

Other advantages and features of the invention will be readily apparent from the following description of the preferred embodiments, the drawings and claims.

DESCRIPTION OF THE PREFERRED EMBODIMENTS

Figure 1:
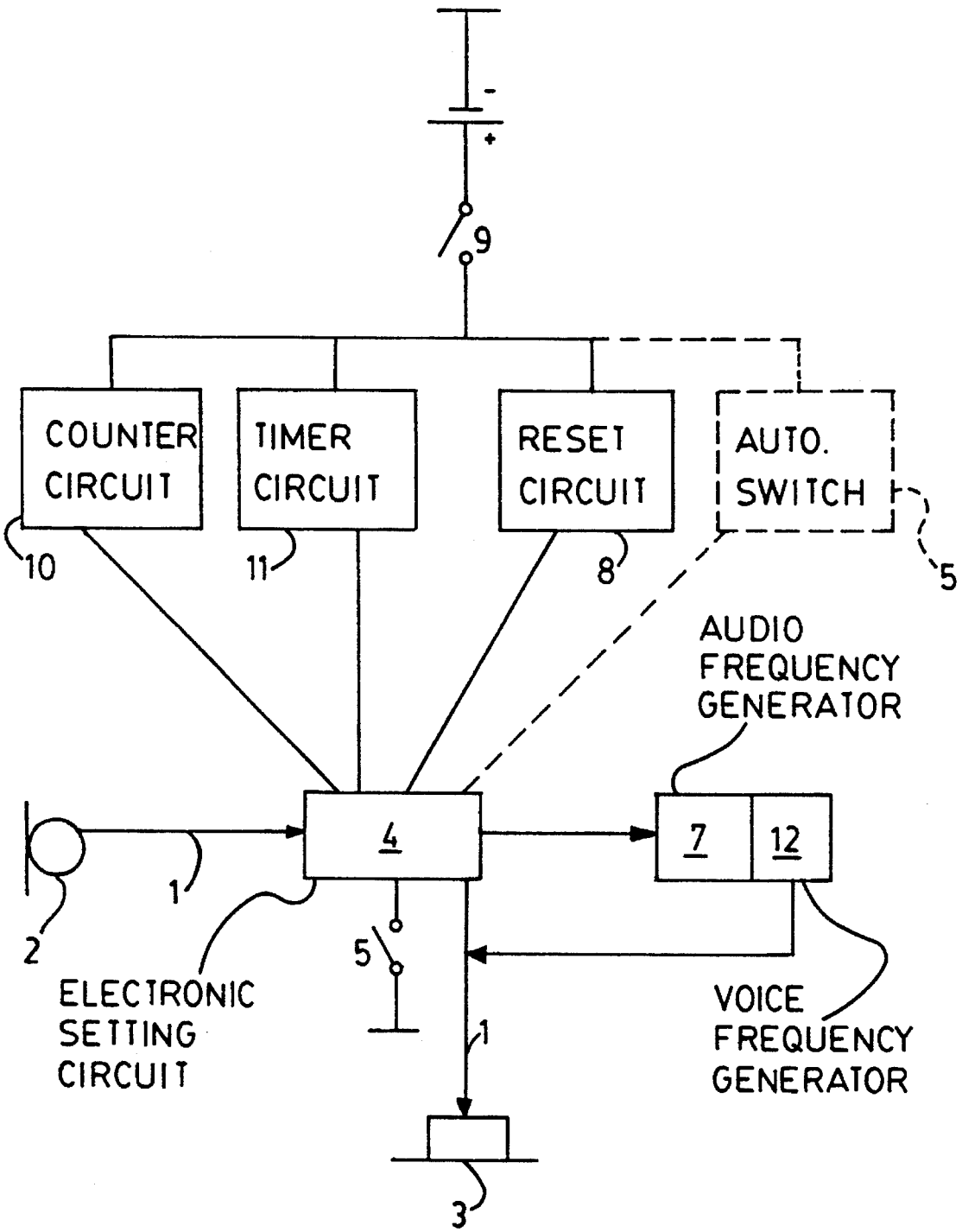
FIG. 1 illustrates a block circuit diagram of a hearing aid constructed in accordance with the principles of the present invention.

FIG. 1 illustrates a block circuit diagram of a hearing aid constructed in accordance with the principles of the present invention. The hearing aid includes an electronic signal path 1 connected between a microphone 2 and an earphone 3. The electronic signal path 1 contains all circuit parts (not shown) necessary for signal processing. Further, the electronic signal path 1 includes at least one electronic setting circuit 4 for electronically setting at least one transmission parameter, such as the volume of the hearing aid, in the signal path 1. The electronic setting circuit 4 can be controlled by a manually actuatable switch 5, or by an automatically operating switch 5'. The electronic setting circuit 4 can be pre-programmed. Pre-programmed settings of transmission parameters in the signal transmission path 1 are then triggered in a known way by actuating the manually actuatable switch 5, or by activation of the automatically actuatable switch 5'.

In a hearing aid 6 constructed in accordance with the principles of the present invention, the manual switch 5, or the automatic switch 5', selectively activates an output signal device, such as an audio frequency generator 7. The manual switch 5 or the automatic switch 5' can control the audio frequency generator 7, such that the audio frequency generator 7 is, for example, briefly switched on at the same time that a transmission parameter is switched by the electronic setting circuit 4. While the audio frequency generator 7 is switched on, an output signal of at least one electrical signal is output to the signal path 1. The output signal differs for every electronically set transmission parameter, and is characteristic of every electronically set transmission parameter. As a result, the user of the hearing aid 6 receives unambiguous information through the earphone 3 concerning the respectively selected and set transmission parameter or, respectively, of the selected and set signal processing program.

In accordance with the exemplary embodiment illustrated in FIG. 1, a reset circuit 8 can be provided in accordance with the principles of the present invention. The reset circuit 8 acts on the electronic setting circuit 4 for the electronic setting of a transmission parameter, and also acts on the audio frequency generator 7. Both the electronic setting circuit 4 and the audio frequency generator 7 can be switched back to an initial position with the reset circuit 8. Such reswitching advantageously occurs given actuation of an on/off switch 9 of the hearing aid 6. However, it is also possible to have the reset circuit 8 trigger given faulty operation of the switch 5, or 5'. As a result, the hearing aid automatically returns into the initial setting of the transmission path 1, given either faulty operation of the switch 5, 5' or actuation by the on/off switch 9.

A counter circuit 10 can also be provided in accordance with the principles of the present invention. The counter circuit 10 is arranged within the interactive connection between the manually actuatable switch 5 and the audio frequency generator 7. The switch signals output by the switch 5 are counted by the counter circuit 10. The audio frequency generator 7 is then controlled, based on the number of switch signals counted by the counter circuit 10. As a result, it is possible to allocate a characteristic audio frequency signal to every switch signal output by the switch 5 in a simple manner.

A timer circuit 11 can also be provided in accordance with the principles of the present invention. The timer circuit 11 provides an interactive connection between the manual actuatable switch 5 and the electronic setting circuit 4 for electronically setting a transmission parameter, as well as the audio frequency generator 7. The influence of the manually actuatable switch 5 on the electronic setting circuit 4 and on the audio frequency generator 7 can be additionally controlled in a time-dependent manner. Further, the control by the manually actuatable switch 5 can occur such that a switching to a new transmission parameter, or new program, only occurs given a repeated actuation, such as a double-actuation, of the switch 5 within a defined time period.

Finally, it is also possible to design the signal output device 7 as a voice frequency generator 12 and/or to couple the signal output device to a voice generator. As a result, a direct announcement of the respectively selected transmission parameter and/or signal processing program can be made to the user through the earphone 3.

Figure 2:
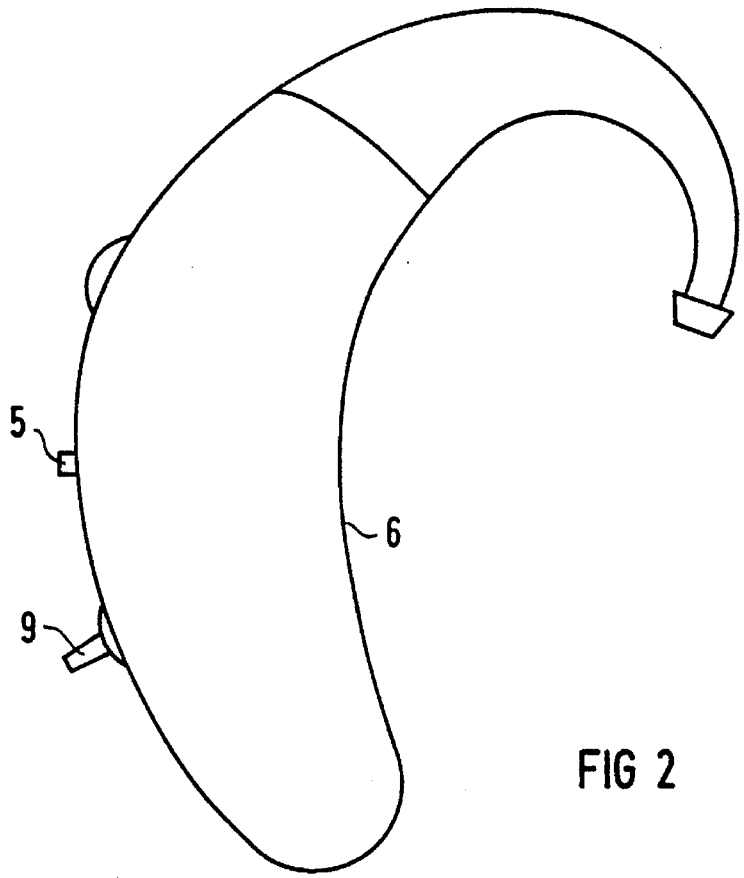
FIG. 2 illustrates a hearing aid constructed in accordance with the principles of the present invention to be worn behind the ear of a user, where a manually actuatable switch is provided.

FIG. 2 illustrates a hearing aid constructed in accordance with the principles of the present invention, wherein the hearing aid is worn behind the ear of a user. The on/off switch 9 and the manually actuatable switch 5 are provided on a surface of the hearing aid. The switch 5 is designed as a key button in the exemplary embodiment illustrated in FIG. 2.

Figure 3:
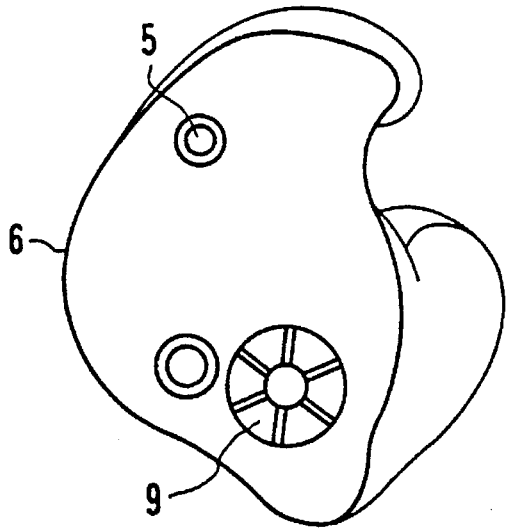
FIG. 3 illustrates a hearing aid constructed in accordance with the principles of the present invention to be worn in the ear of the user, where a manually actuatable switch is provided.

FIG. 3 illustrates a hearing aid constructed in accordance with the principles of the present invention to be worn in an ear of the user, or a concha hearing aid. FIG. 3 illustrates the externally visible face plate of the hearing aid 6. In accordance with this embodiment of a hearing aid constructed in accordance with the principles of the present invention, a key button is provided as the switch 5. Further, the on/off switch 9 is combined with the volume control in this embodiment.

Although various minor modifications may be suggested by those versed in the art, it should be understood that I wish to embody within the scope of the patent granted hereon all such modifications as reasonably and properly come within the scope of my contribution to the art.

I claim:

1. A hearing aid for an impaired user comprising:

a microphone;

an earphone connected to said microphone via a signal path;

at least one electronic setting means, electrically connected to said microphone and to said earphone, for setting a transmission parameter in said signal path between said microphone and said earphone;

signal output means, electrically connected to said at least one electronic setting means and to said earphone, said signal output means including an audio frequency generator, for transmitting a signal to said earphone having an audio frequency generated by said audio frequency generator for causing said earphone to emit a tone which uniquely identifies the transmission parameter which has been set by said at least one electronic setting means; and switch means, electrically connected to said at least one electronic setting means and connected via said at least one electronic setting means to said signal output means, for selectively activating said at least one electronic setting means and said signal output means.

2. A hearing aid as claimed in claim 1, wherein said switch means is automatically actuated.

3. A hearing aid as claimed in claim 2, wherein said transmission parameter is preprogrammed, and wherein said transmission parameter is selectable based on a sound environment of said user.

4. A hearing aid as claimed in claim 1, further comprising a reset circuit connected to said at least one electronic setting means, wherein said reset circuit is electrically activated by at least one of faulty operation of said switch means and actuation of an on/off switch provided on said hearing aid.

5. A hearing aid as claimed in claim 1, further comprising a counter circuit connected via said at least one electronic setting means to said switch means and via said at least one electronic setting means to said signal output means, said counter circuit counting output signals from said switch means and controlling said signal output means based on a counter reading of said counter circuit.

6. A hearing aid as claimed in claim 1, wherein said signal output means is further defined by a voice generator.

7. A hearing aid as claimed in claim 1, wherein said switch means is further defined by a manually actuatable switch, said hearing aid further comprising a timer circuit connected via said setting means to said manually actuatable switch for controlling said manually actuatable switch.

* * * * *